US009979085B2

(12) United States Patent
Mitu et al.

(10) Patent No.: US 9,979,085 B2
(45) Date of Patent: May 22, 2018

(54) FERRITE-LOADED CIRCULAR WAVEGUIDE ANTENNA FOR 3D SCANNING

(71) Applicant: KING FAHD UNIVERSITY OF PETROLEUM AND MINERALS, Dhahran (SA)

(72) Inventors: Sheik Sharif Iqbal Mitu, Dhahran (SA); Abdullah Mohammed Al-Garni, Dhahran (SA); Hassan Ali Ragheb, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 139 days.

(21) Appl. No.: 15/092,580

(22) Filed: Apr. 6, 2016

(65) Prior Publication Data

US 2016/0329637 A1 Nov. 10, 2016

Related U.S. Application Data

(60) Provisional application No. 62/158,517, filed on May 7, 2015.

(51) Int. Cl.
*H01Q 19/00* (2006.01)
*H01Q 3/44* (2006.01)
(Continued)

(52) U.S. Cl.
CPC ..... *H01Q 3/44* (2013.01); *H01Q 7/08* (2013.01); *H01Q 13/06* (2013.01); *H01Q 19/08* (2013.01)

(58) Field of Classification Search
USPC ..... 343/756, 768; 333/24.3, 258
See application file for complete search history.

(56) References Cited

U.S. PATENT DOCUMENTS 3,013,266 A 12/1961 Wheeler
3,787,869 A * 1/1974 Charlton ..... H01Q 13/04 333/21 A (Continued)

OTHER PUBLICATIONS

Sheikh Sharif Iqbal, Hassan Aly Ragheb, "Design of a Directive Ferrite Loaded Waveguide Antenna for Multi-directional Beam Steering," KFUPM Research Proposal, Feb. 10, 2012.

(Continued)

*Primary Examiner* — Jessica Han
*Assistant Examiner* — Hai Tran
(74) *Attorney, Agent, or Firm* — Richard C. Litman

(57) ABSTRACT

The ferrite-loaded circular waveguide antenna for 3D scanning includes the design and optimization of an axially magnetized ferrite loaded circular waveguide antenna with three-dimensional (3D) scan characteristics. The ferrite cylinder is concentrically placed within the circular waveguide and magnetized using solenoid coils wound around the waveguide. The waveguide antenna is excited using an optimally positioned coaxial connector. By changing the magnetic biasing of the ferrite cylinder, individual modes within the multi-mode wave guide are affected separately. This generates tapered $E_y$-field distribution in the radiating edge of the waveguide, which leads to beam scan. Professional software is used to optimize the dimension and magnetizing requirement of the antenna to realize up to ±30° of beam scan in the azimuth and elevation planes. The magnetizing fields ($H_0$) required for the 3D scan are tabulated. A prototype of the high power antenna is fabricated to experimentally verify the simulated scan characteristics.

6 Claims, 10 Drawing Sheets

(51) Int. Cl.

| | |
|---|---|
| ***H01Q 7/08*** | (2006.01) |
| ***H01Q 13/06*** | (2006.01) |
| ***H01Q 19/08*** | (2006.01) |

(56) References Cited

U.S. PATENT DOCUMENTS

| | | | | |
|---|---|---|---|---|
| 4,814,782 | A | 3/1989 | Chai | |
| 5,014,071 | A | 5/1991 | King | |
| 5,122,810 | A * | 6/1992 | Nisbet | H01P 1/175 333/21 A |
| 7,173,577 | B2 | 2/2007 | Brown et al. | |
| 2006/0151485 | A1 * | 7/2006 | Cronin | A61B 18/18 219/690 |

OTHER PUBLICATIONS

Sheikh Sharif Iqbal Mitu and Farooq Sultan, "Beam Scanning Properties of a Ferrite Loaded Microstrip Patch Antenna," International Journal of Antennas and Propagation, vol. 2015, Article ID 697409, 8 pages, (Jan. 2015). doi:10.1155/2015/697409.

* cited by examiner

300

500

700

FERRITE-LOADED CIRCULAR WAVEGUIDE ANTENNA FOR 3D SCANNING

CROSS-REFERENCE TO RELATED APPLICATION

This application claims the benefit of U.S. Provisional Patent Application Ser. No. 62/158,517, filed May 7, 2015.

BACKGROUND OF THE INVENTION

1. Field of the Invention

The present invention relates to microwave antennas, and particularly to a ferrite-loaded circular waveguide antenna for 3D scanning having a magnetizing coil adapted for connection to a current source in order to alter the biasing of the ferrite member to realize three-dimensional (3D) beam scanning.

2. Description of the Related Art

High power microwave applications, such as radars and transmitter antennas, often require three-dimensional beam steering capabilities. Waveguide antennas are popular in high power devices, but introducing reconfigurable coverage using phased array technique often becomes impractical due to the large size of the array. In the literature, multimode waveguide antennas are investigated to introduce beam steering and reduction of side lobe levels. The gain and directivity improvement of the circular waveguide antenna is demonstrated by loading dielectric or electromagnetic band gap (EBG) material. Beam scanning using magnetized ferrite-loaded waveguide slot array is studied in another reference work. Although ferrites are widely used in high power control devices, like phase shifters and circulators, it is yet to be used to realize multi-directional beam scan of a single waveguide antenna.

Thus, a ferrite-loaded circular waveguide antenna for 3D scanning solving the aforementioned problems is desired.

SUMMARY OF THE INVENTION

The ferrite-loaded circular waveguide antenna for 3D scanning has a ferrite rod concentrically disposed inside a circular waveguide. The ferrite rod is axially magnetized with an external DC biasing field ($H_0$ or $H_{dc}$) for multidirectional (3D) beam forming. Mode-chart of the ferrite-loaded waveguide antenna is calculated to determine the optimum dimensions, filling factor, and material properties required to avoid operating in the lossy ferromagnetic resonance region. With proper magnetizing conditions, beam scan is achieved by altering the surface electric-field distribution at the open-end of the multi-mode waveguide. This requires controlling the relative phase and/or amplitude of the multi-mode signal, which depends on the effective permeability of the ferrite-loaded waveguide. Professional software is used to optimize the reflection response and the radiation patterns to demonstrate the multi-directional (3D) beam scanning behavior. Based on the beam-width of the antenna, the broadside radiating plane is divided into eight azimuthal regions. For each azimuthal region, the external magnetizing field needed to scan the main beam in the elevation plane is tabulated, as shown later. The prototype of the optimized antenna is fabricated and tested to experimentally verify simulated radiation responses.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
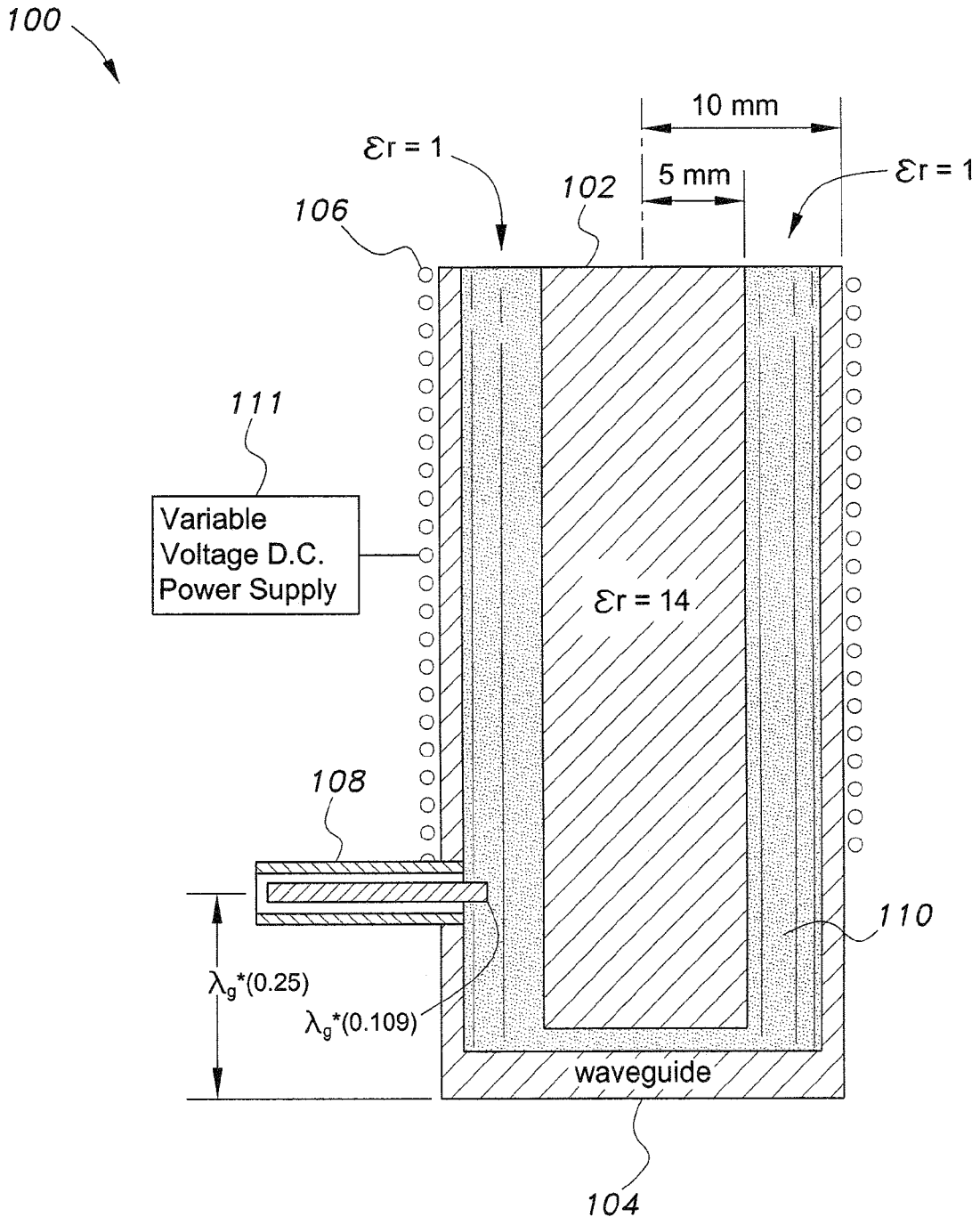
FIG. 1A is a diagrammatic side view in section of a ferrite-loaded circular waveguide antenna for 3D scanning according to the present invention.
Figure 1B:
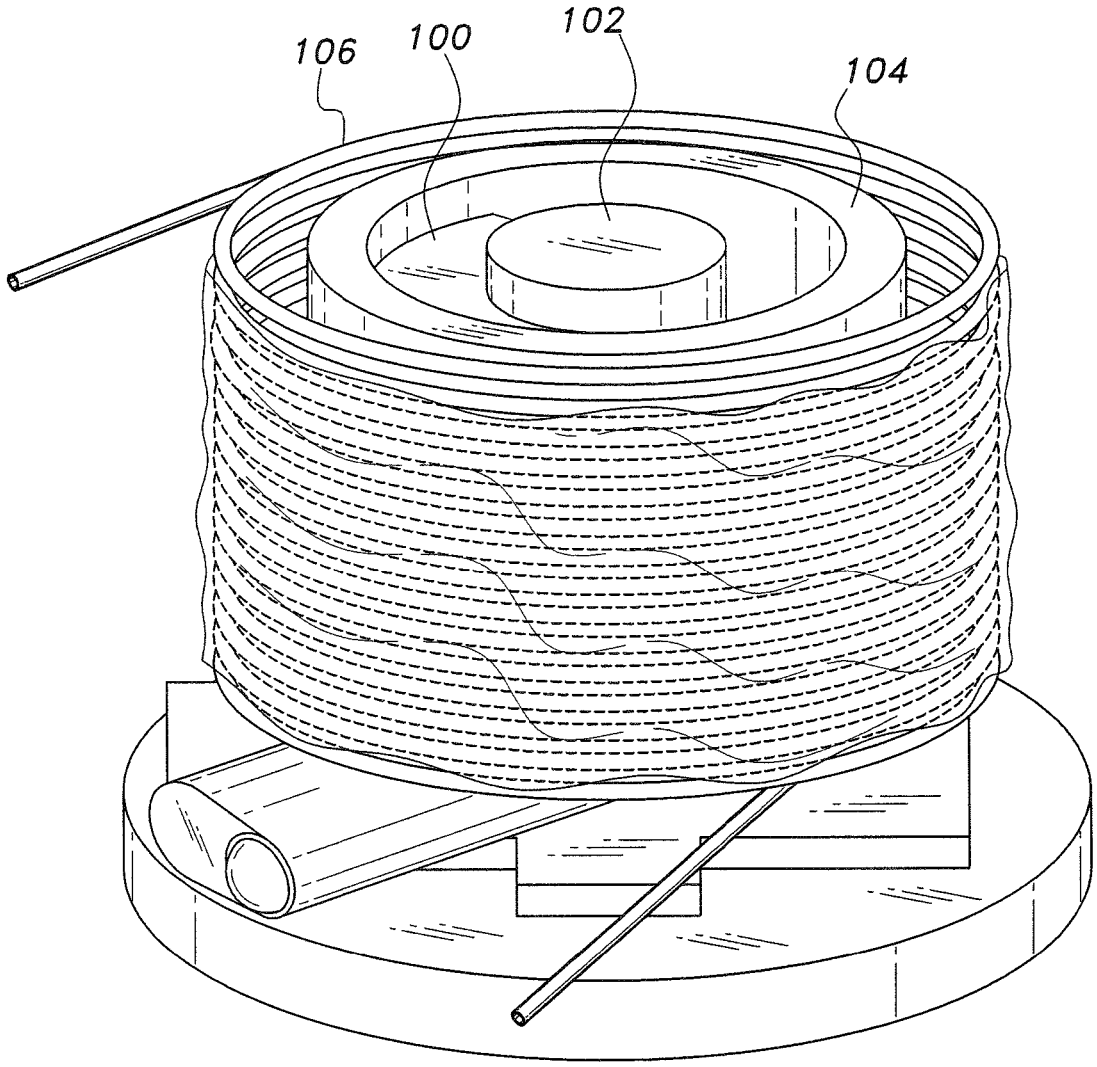
FIG. 1B is a perspective view of a ferrite-loaded circular waveguide antenna for 3D scanning according to the present invention.

As shown in FIGS. 1A, 1B, the simulated and fabricated model of the 10 GHz ferrite-loaded circular waveguide antenna 100 has a ferrite rod 102 disposed inside a circular waveguide 104 and is retained by a foam (e.g., Styrofoam) structure 110. The antenna 100 is axially magnetized with an external biasing field ($H_0$) by energizing a magnetizing field coil 106, which is wrapped around the exterior of the waveguide 104. Variable coil current from the DC power source 111 introduces changes in the direction and magnitude of the magnetizing field ($H_0$), which results in 3D beam scanning. The variable voltage DC power supply 111 is used to continuously energize the field coil 106 of the electromagnet. This high power antenna should be capable of transmitting and receiving signals from desired directions in azimuth and elevation planes.

High power microwave applications, such as radars and transmitter antennas, often require beam steering capabilities. Circular waveguides are widely used to construct high power multimode horn antennas. In the literature, researchers have demonstrated that the gain and directivity of a circular waveguide antenna can be improved by loading dielectric or electromagnetic band gap (EBG) material. The present circular waveguide 104 is concentrically loaded with an axially magnetized ferrite rod 102 to introduce externally controlled beam steering properties. Ferrite is selected due to its popular use in high power control devices, such as polarizers, rotary field phase shifters, and junction circulators. They are also used as phase shifters in phased-array antennas, where the interaction between the gyromagnetic properties of ferrite and the propagating electromagnetic wave can be controlled by an external biasing field.

At microwave frequencies (f), if a ferrite cylinder is axially magnetized by a dc magnetic field ($H_0$), its gyromagnetic properties can be expressed by the tensor permeability of the form:

$$[\mu_r] = \begin{bmatrix} \mu & -j\kappa & 0 \\ j\kappa & \mu & 0 \\ 0 & 0 & \mu_z \end{bmatrix}, \quad (1)$$

where $$M_\mu = 1 + \frac{\gamma^2 H_0 M}{(\gamma H_0)^2 - f^2}, \quad (2)$$

$$k = \frac{\gamma M f}{(\gamma H_0)^2 - f^2},$$

'γ' being the gyromagnetic ratio, and 'M' being the magnetization of the ferrite material. Substituting this into Maxwell's equations with open sidewall boundary conditions, the mode charts of the ferrite-loaded circular waveguide can be calculated. The coaxial excitation, dimensions and filling factor of the ferrite-loaded antenna may be optimized to achieve desired radiation properties for a specific frequency range.

An exemplary coaxially fed ferrite-loaded circular waveguide antenna 100 is designed to operate at 10 GHz. A professional software simulator is used to optimize the ferrite rod 102 loaded into the circular waveguide 104 and the coaxial-feeder 108 to allow maximum power transfer from the feeder 108 to the waveguide 104. The coaxial-feeder structure 108 is connected to the waveguide in a manner that displaces it from a terminal end of the waveguide by approximately $0.25\times\lambda_g$, where $\lambda_g$ is the guide wavelength. The coaxial-feeder 108 protrudes into the interior of the waveguide by no more than approximately $0.109\times\lambda_g$. The internal radius of the waveguide and ferrite are selected to be 10 mm and 5 mm, respectively to excite multi-mode signal at 10 GHz.

Figure 2:
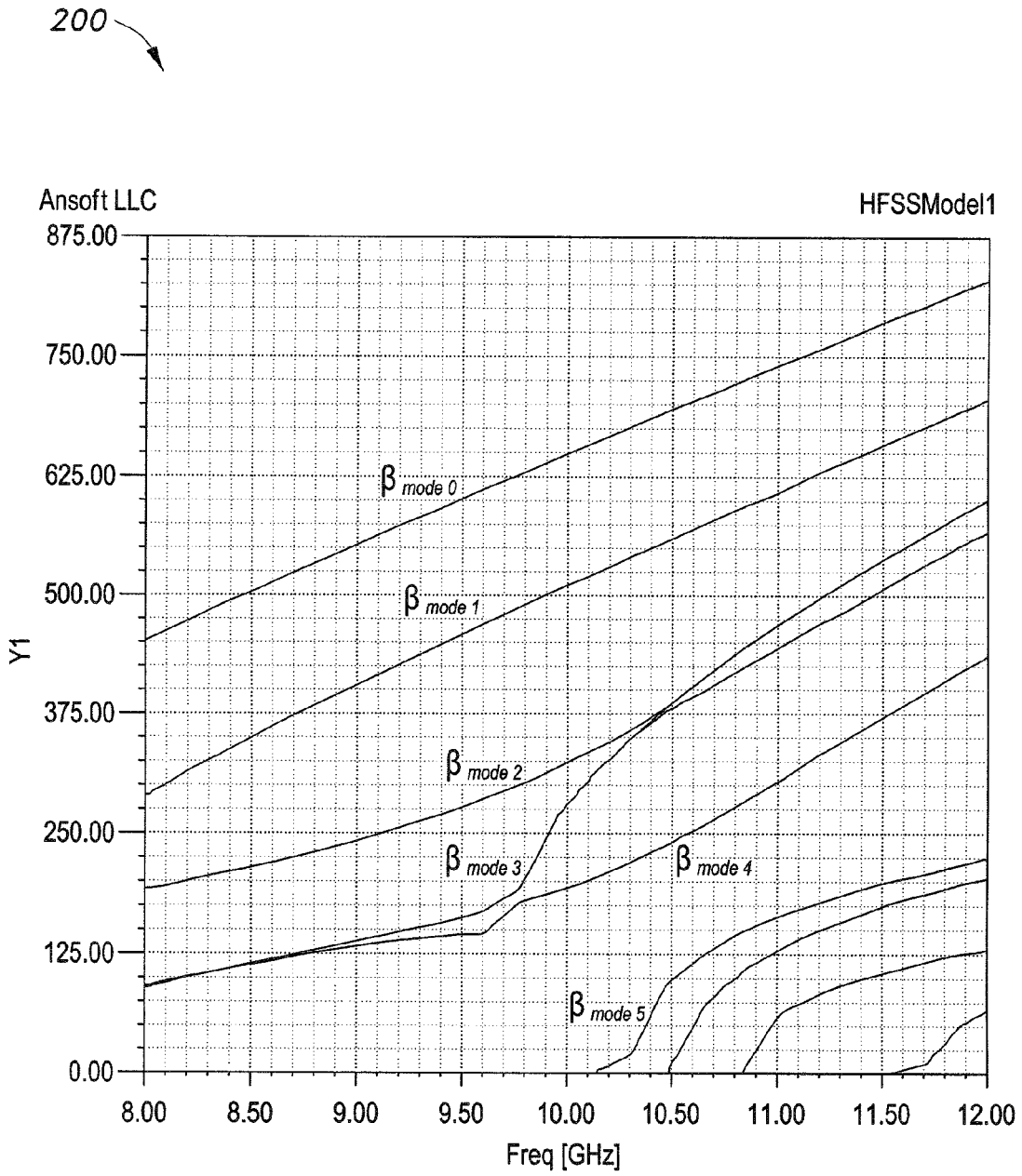
FIG. 2 is a simulated phase-constant (β) versus frequency (f) chart of the ferrite-loaded circular waveguide antenna for 3D scanning according to the present invention.

Plot 200 of FIG. 2 shows the first nine modes of the ferrite-loaded circular waveguide antenna. Mode charts are essential in selecting the dimensions and material properties of the antenna component to ensure that the desired operating regions are away from the lossy ferromagnetic resonance.

Figure 3:
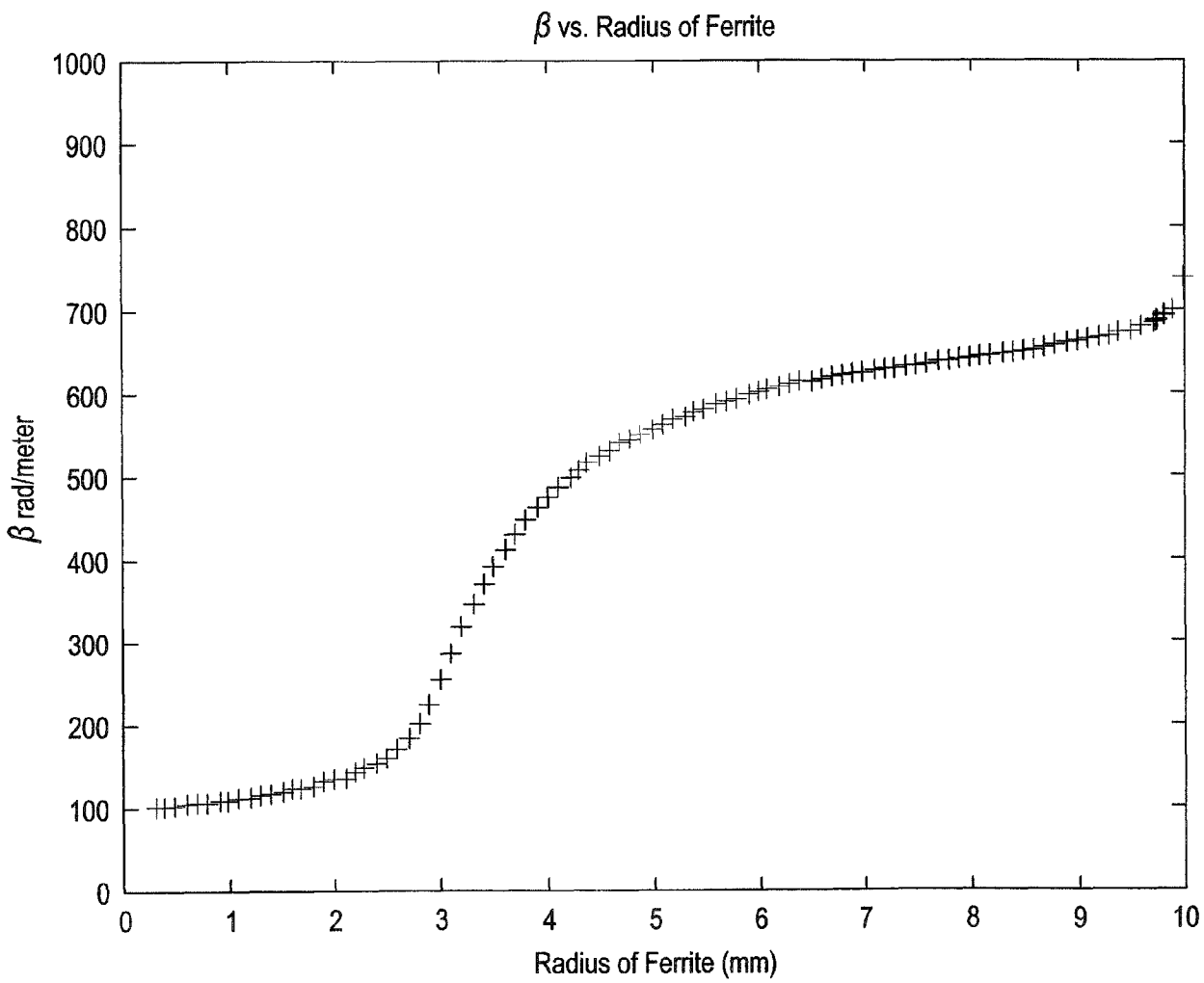
FIG. 3 is a graph showing the tapered Ey-phase of the radiated wave above the magnetized ferrite cylinder of the ferrite-loaded circular waveguide antenna for 3D scanning according to the present invention.

To achieve beam scan, the axial magnetizing field ($H_0$) is used to control the phase distribution of the hybrid mode that resulted in a tapered E-field phase distribution at the radiating edge of the waveguide 101. For $H_0$=69 KA/m, the calculated phase distribution of the Hybrid mode across the radiating edge of the ferrite cylinder is shown in plot 300 of FIG. 3.

Figure 4:
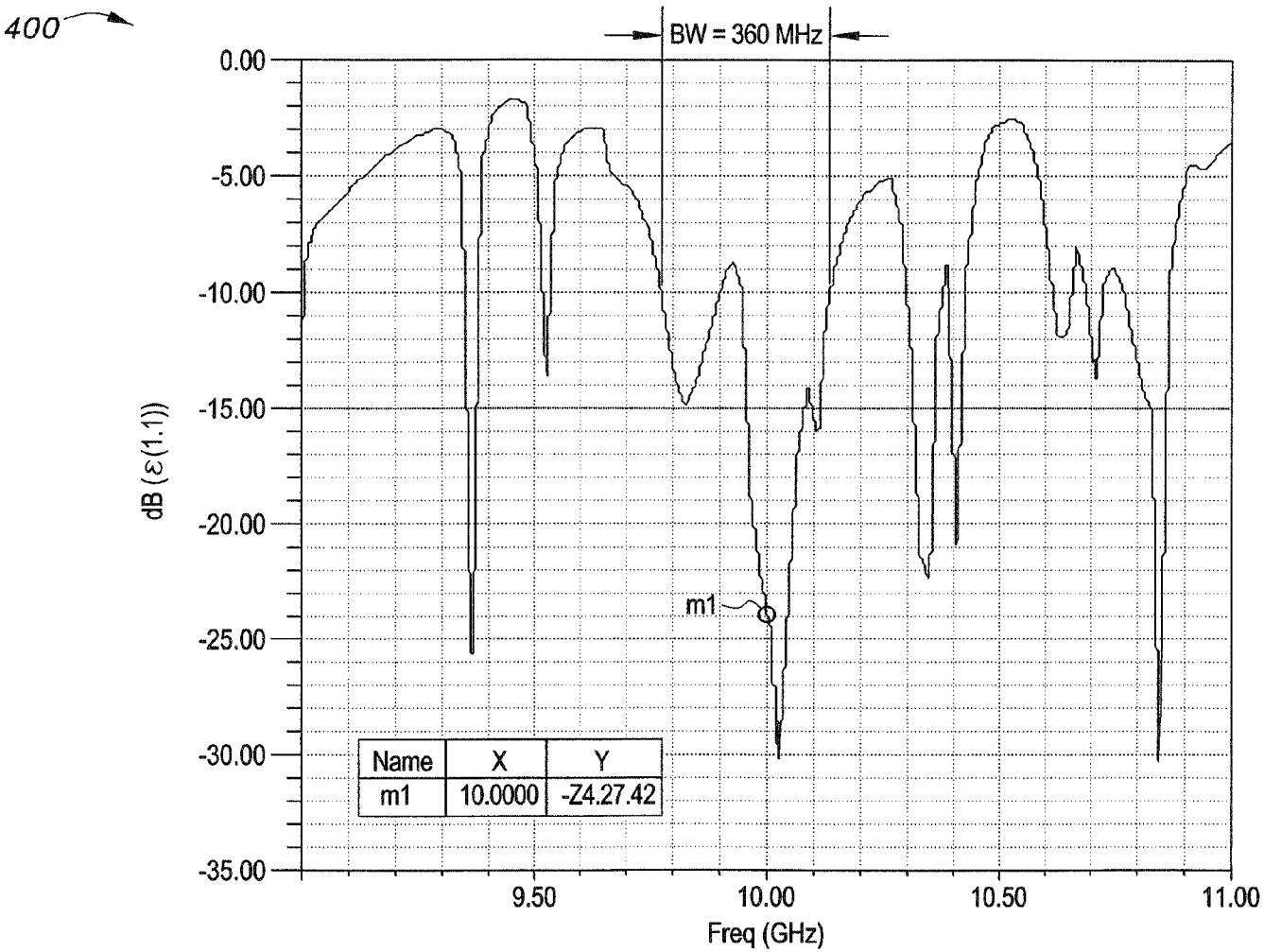
FIG. 4 is a graph showing the reflection response (S11) of the ferrite-loaded circular waveguide antenna for 3D scanning according to the present invention.

Using HFSS software, the simulated reflection response ($S_{11}$) of the optimized ferrite-loaded circular waveguide antenna is shown in plot 400 of FIG. 4. Note that for no biasing condition, the impedance bandwidth of the 10 GHz antenna is 360 MHz.

A circular waveguide 104, concentrically loaded with a ferrite rod 102, is optimized to demonstrate externally controllable beam scanning. The main beam of the antenna 100 is steered by changing the axially applied magnetizing field ($H_0$), used to bias the ferrite rod 102. For three values of magnetizing field, the simulated beam scan in the x-plane (φ=0°), perpendicular to that of the coaxial feed (y-plane), is shown in plot 500 of FIG. 5. Note that the antenna demonstrates a beam width of 60°. The beam scan of φ=±30° in φ=0° plane is achieved through changing the magnetizing field by $H_0$=±142 KA/m.

Figure 5:
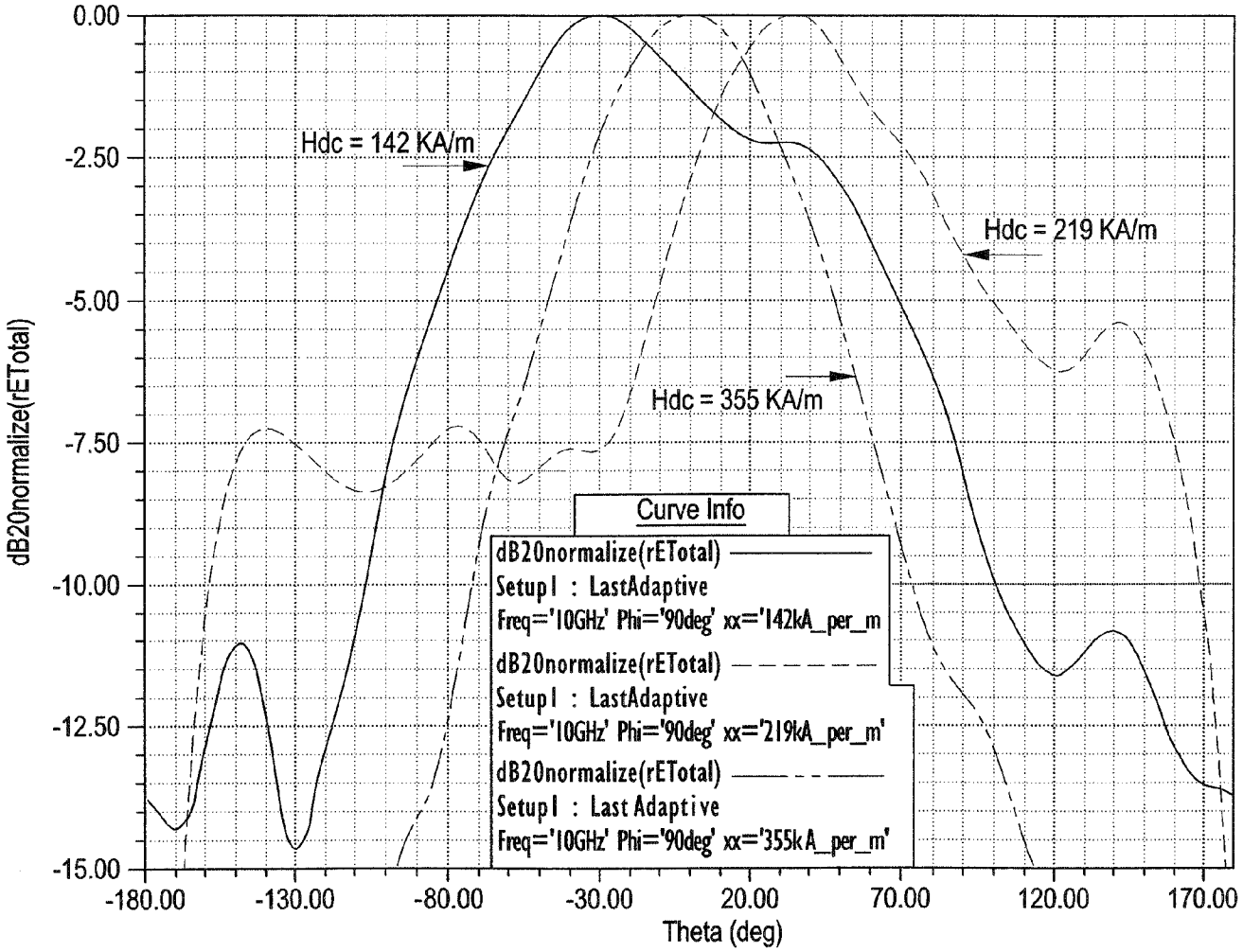
FIG. 5 is a graph showing the antenna beam scan for an elevation angle of θ=±30° in φ=0° plane and required values of external magnetizing field, $H_{dc}$ for a ferrite-loaded circular waveguide antenna for 3D scanning according to the present invention.

To demonstrate three-dimensional (3D) scanning capacity of the antenna, the azimuthal radiation plane of the antenna aperture is divided into eight regions, as shown in FIG. 5. Note that φ=0° plane is associated with regions 2 and 6 and φ=90° plane is associated with regions 4 and 8 (with coaxial feed).

For different magnetizing conditions, the simulated 3D beam scanning properties of the antenna are listed in Table 1. Note that in each azimuthal region, the magnetizing field ($H_0$) needed to scan the main beam in two different elevation angles (θ=15°, θ=30°) are tabulated.

Figure 6:
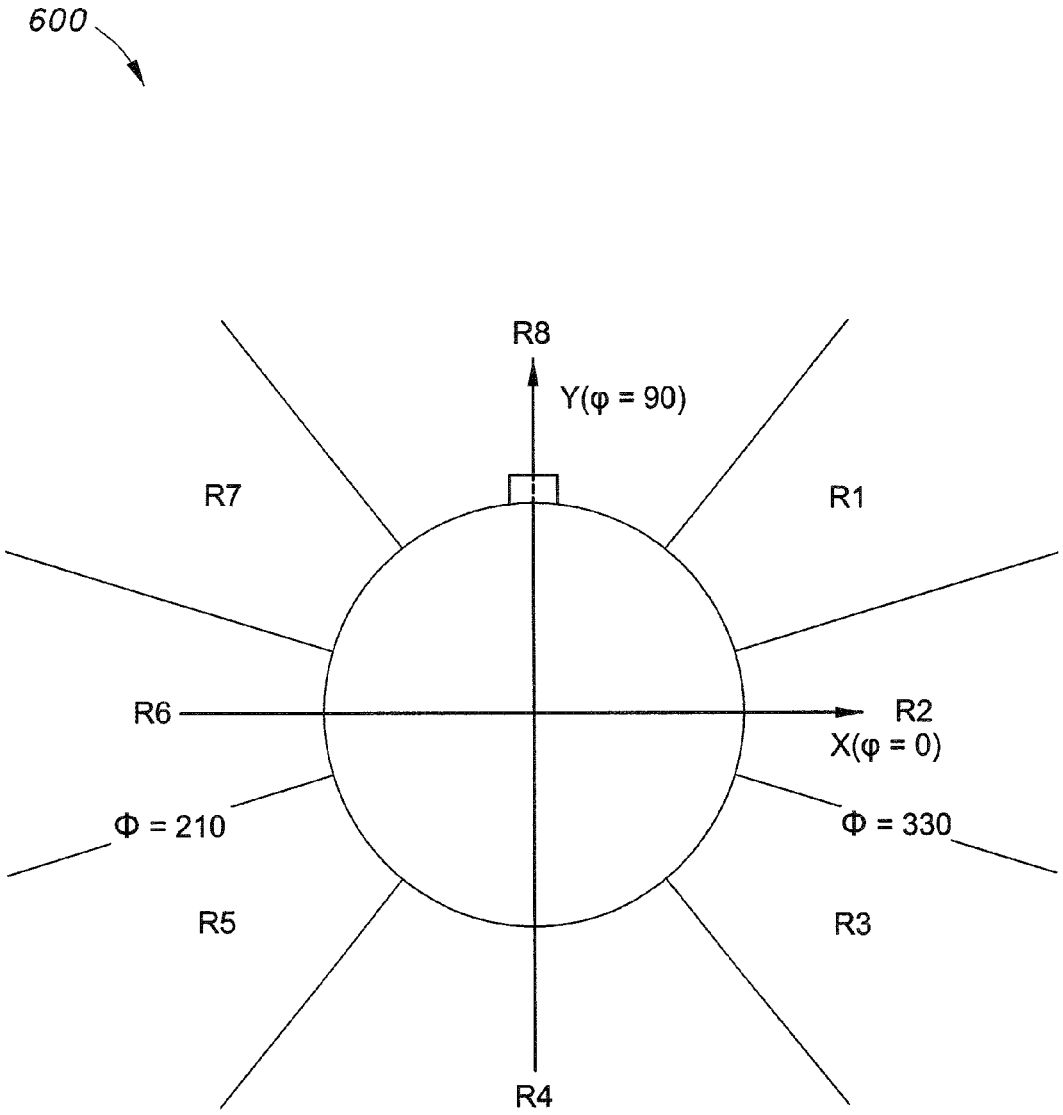
FIG. 6 is a graph showing the far field radiation regions in the azimuthal plane (φ.)

FIG. 6, plot 600 demonstrates the multi-directional beam scanning properties of the antenna by showing the beam scan of θ=±30° in θ=90° plane (R4 and R8) for magnetizing biasing of $H_0$=63 and 171 KA/m. The main beam of the antenna can also be scanned towards the border of two azimuthal regions.

Figure 7:
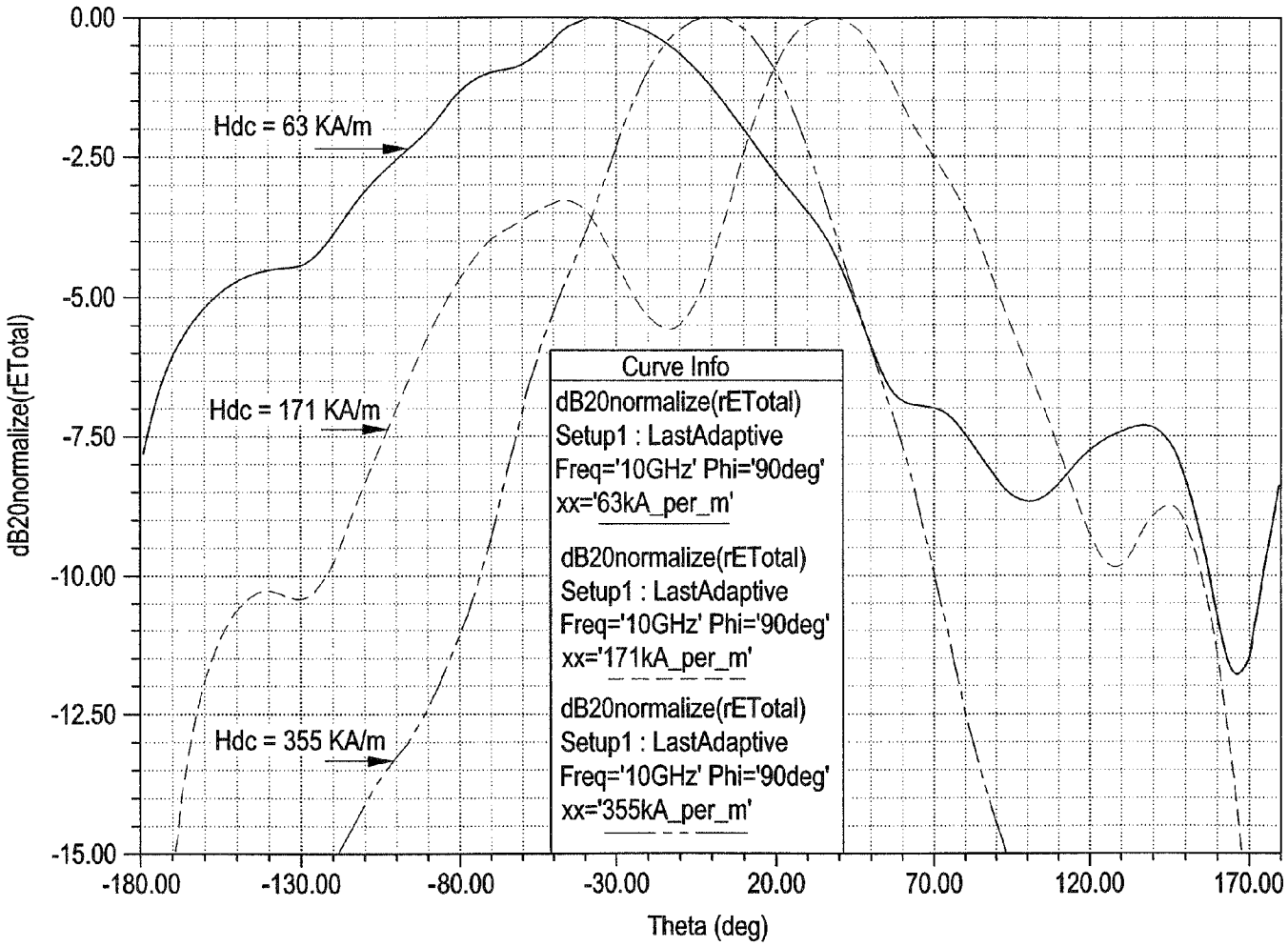
FIG. 7 is a graph showing the antenna beam scan for an elevation angle of θ=±30° in φ=90° plane and required external magnetizing fields $H_{dc}$ for a ferrite-loaded circular waveguide antenna for 3D scanning according to the present invention.
Figure 8A:
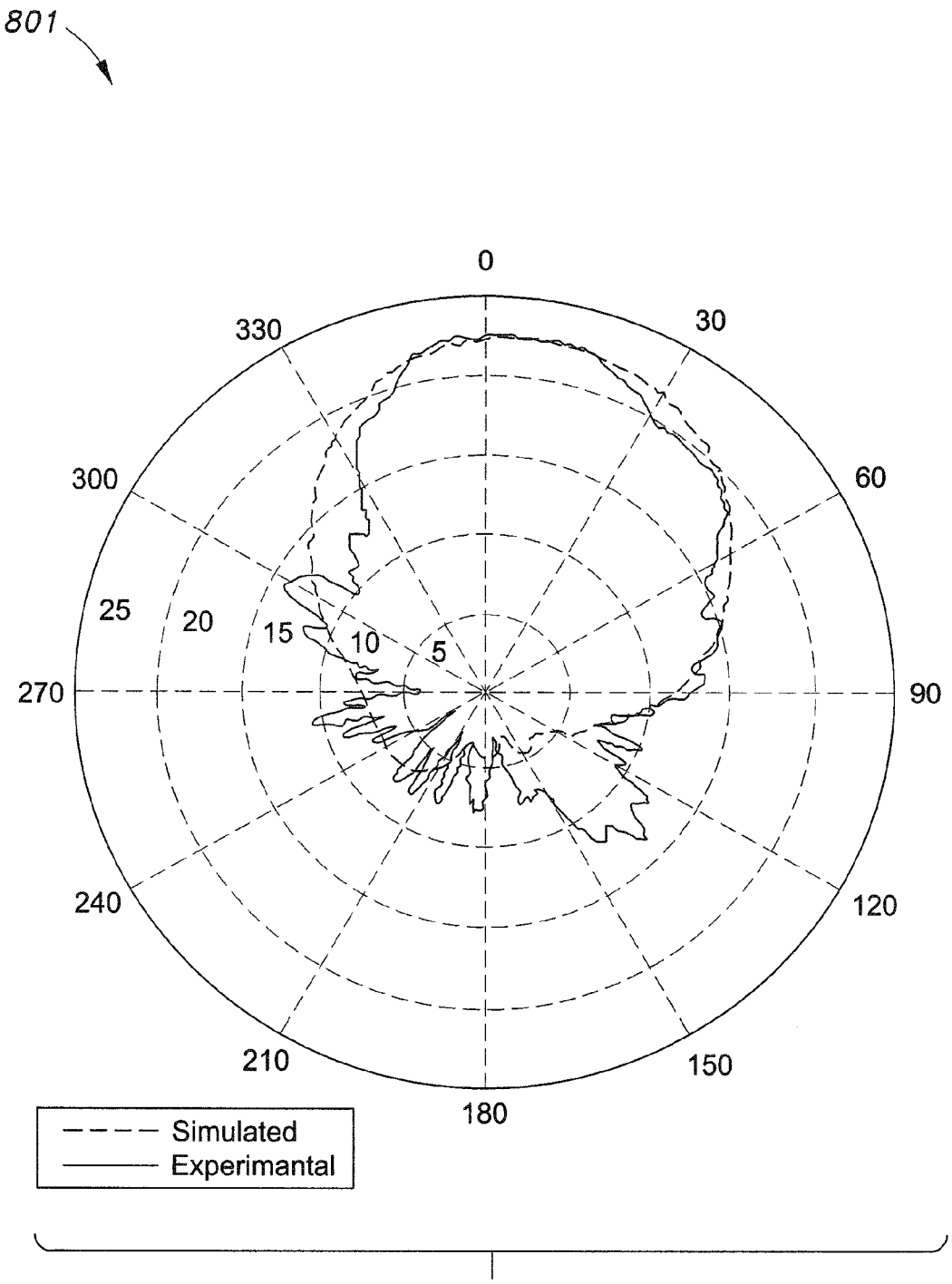
FIG. 8A is a graph showing experimentally verified beam scan in φ=0° plane: θ=+15° (in R2) for $H_0$=−69 KA/m for a ferrite-loaded circular waveguide antenna for 3D scanning according to the present invention.
Figure 8B:
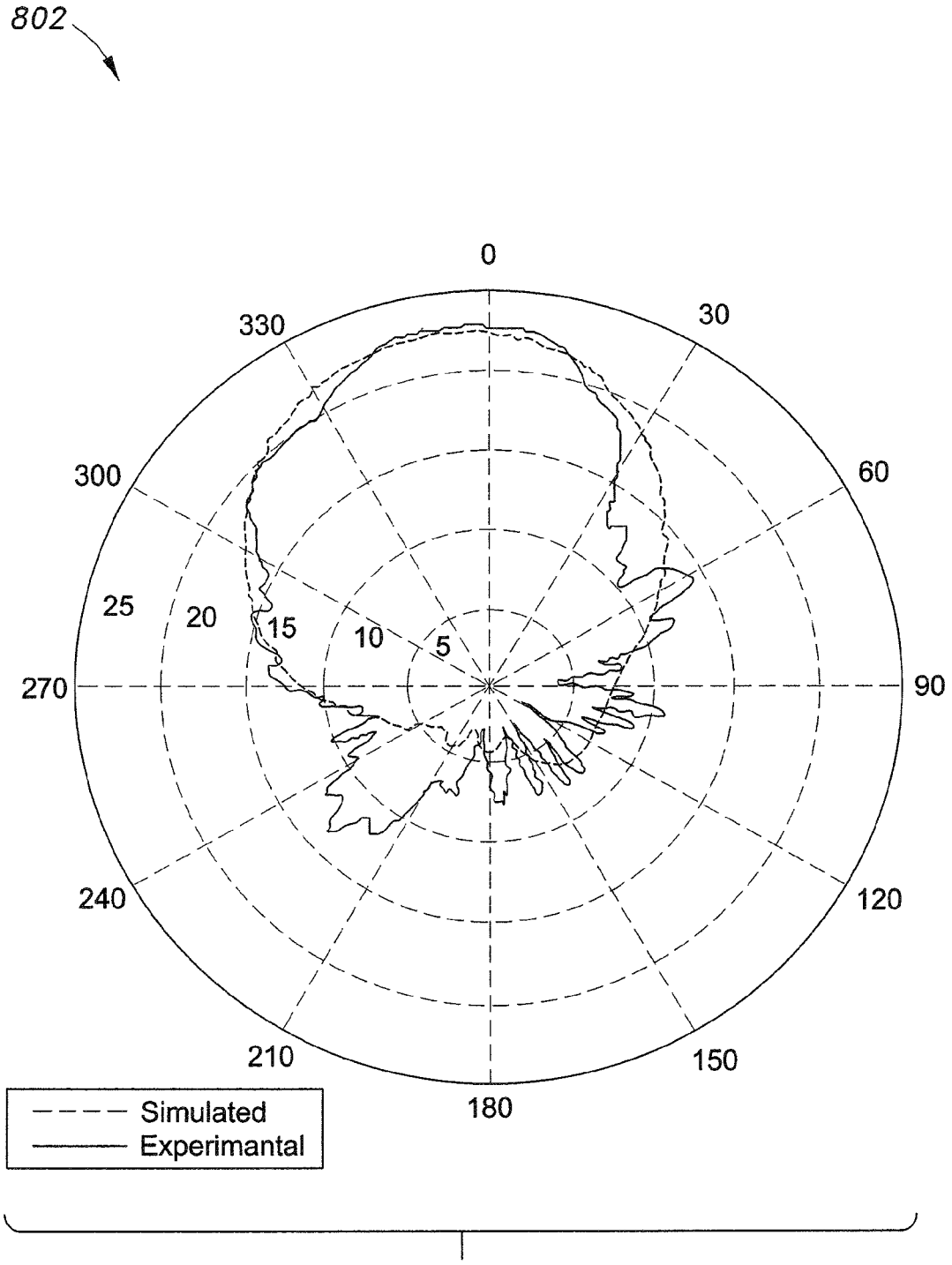
FIG. 8B is a graph showing experimentally verified beam scan in φ=0° plane θ=−15° (in R6) for $H_0$=69 KA/m for a ferrite-loaded circular waveguide antenna for 3D scanning according to the present invention.

The experimental prototype of the optimized antenna is fabricated, as shown in FIG. 1B. The experimentally observed radiation patterns in φ=0° plane of the fabricated antenna is shown in plot 700 of FIG. 7. Note that the superimposed curves of experimental and simulated radiation patterns demonstrate good agreement. As shown in FIGS. 8A and 8B (plot 801 and plot 802, respectively), the beam scan of θ=+15° (in R2 region) is achieved by $H_0$=−69-KA/m, and θ=−15° (in R6 region) is achieved by $H_0$=69-KA/m. Note that experimentally observed radiation patterns are also in good agreement with the tabulated values of Table 1. The negative sign of $H_0$ means oppositely (−z axis) applied magnetizing field. Due to the absence of required magnetizing coils, beam scan in other directions could not be experimentally verified.

TABLE 1

Computer simulated beam scanning properties

| Azimuthally Radiation Regions | Elevation - Angle Theta θ° | $H_{dc}$, kA/m | Maximum Magnitude (V) |
|---|---|---|---|
| R = 1 | 15° | −65 | 20.5 |
| 30° > ϕ > 60° | 30° | −76.4 | 19 |
| R = 2 | 15° | −69 | 20.3 |
| 330° > ϕ > 30° | 30° | −142 | 18.7 |
| R = 3 | 15° | 225 | 19.4 |
| 300° > ϕ > 330° | 30° | 177 | 18.5 |
| R = 4 | 15° | 54 | 23.7 |
| 240° > ϕ > 300° | 30° | 63 | 20 |
| R = 5 | 15° | −225 | 19.8 |
| 210° > ϕ > 240° | 30° | −220 | 19.4 |
| R = 6 | 15° | 69 | 20.3 |
| R = 60° > ϕ > 210° | 30° | 142 | 18.7 |
| R = 7 | 15° | 65 | 20.5 |
| 120° > ϕ > 150° | 30° | 76.4 | 19 |
| R = 8 | 15° | 91 | 21.4 |
| 60° > ϕ > 120° | 30° | 171 | 18 |

It is to be understood that the present invention is not limited to the embodiments described above, but encompasses any and all embodiments within the scope of the following claims.

We claim:

1. A ferrite-loaded circular waveguide antenna for 3D scanning, comprising:

a circular waveguide having an internal radius of about 10 mm;

a ferrite cylinder concentrically loaded within the circular waveguide, said ferrite cylinder comprising a ferrite rod having an internal radius of about 5 mm;

a coil wound around the circular waveguide; and a variable voltage dc power supply connected to the coil in order to bias the ferrite cylinder with an axially applied magnetic field, whereby a beam transmitted by the ferrite-loaded circular waveguide antenna for 3D scanning is steered in a desired direction by altering a magnetic field bias applied to the ferrite cylinder in the circular waveguide.

2. The ferrite-loaded circular waveguide antenna according to claim 1, wherein the ferrite rod has a relative dielectric permittivity, $\epsilon_r$, of about 14.

3. The ferrite-loaded circular waveguide antenna according to claim 1, further comprising foam disposed around the ferrite rod to retain the ferrite rod inside the waveguide.

4. The ferrite-loaded circular waveguide antenna according to claim 3, wherein the foam has a relative dielectric permittivity, $\epsilon_r$, of about 1.

5. The ferrite-loaded circular waveguide antenna according to claim 4, further comprising a feeder structure connected to the waveguide, the feeder structure being displaced from a terminal end of the waveguide by about $0.25\times\lambda_g$, where $\lambda_g$ is the waveguide wavelength.

6. The ferrite-loaded circular waveguide antenna according to claim 5, wherein the feeder structure protrudes into the interior of the waveguide by no more than about $0.109\times\lambda_g$.

* * * * *